US009862191B2

(12) United States Patent
Maruyama et al.

(10) Patent No.: US 9,862,191 B2
(45) Date of Patent: Jan. 9, 2018

(54) LIQUID HOLDING CONTAINER

(71) Applicant: CANON KABUSHIKI KAISHA, Tokyo (JP)

(72) Inventors: Ryohei Maruyama, Kawasaki (JP); Noriyuki Aoki, Tokyo (JP); Shigeru Watanabe, Yokohama (JP); Toshiro Sugiyama, Yokohama (JP); Tsutomu Obata, Tokyo (JP); Naoaki Wada, Yokohama (JP); Ryuichi Kato, Yokohama (JP); Kouhei Tokuda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/271,779

(22) Filed: Sep. 21, 2016

(65) Prior Publication Data

US 2017/0090400 A1 Mar. 30, 2017

(30) Foreign Application Priority Data

Sep. 30, 2015 (JP) ..... 2015-194016

(51) Int. Cl.
*B41J 2/165* (2006.01)
*B41J 2/17* (2006.01)

(52) U.S. Cl.
CPC ..... *B41J 2/165* (2013.01); *B41J 2/16547* (2013.01); *B41J 2/1721* (2013.01)

(58) Field of Classification Search
CPC ..... B41J 11/0065; B41J 2/1721; B41J 2002/1728; B41J 2002/1742; G03G 21/12
See application file for complete search history.

(56) References Cited

U.S. PATENT DOCUMENTS 4,466,452 A * 8/1984 Ferrari ..... A45D 29/007 132/75
6,457,803 B1 * 10/2002 Ohkoda ..... B41J 2/16523 347/35
6,866,363 B2 3/2005 Oku
6,890,057 B2 * 5/2005 Gotoh ..... B41J 2/16523 347/31
7,654,664 B2 * 2/2010 Watanabe ..... B41J 11/0065 347/101
8,567,902 B2 * 10/2013 Kobayashi ..... B41J 2/185 347/36
2002/0041303 A1 * 4/2002 Yoshinaga ..... B41J 2/1721 347/22
2003/0214549 A1 * 11/2003 Ogasawara ..... B41J 2/20 347/35
2010/0231676 A1 * 9/2010 Miyagi ..... B41J 2/16585 347/104

FOREIGN PATENT DOCUMENTS

JP 2003-312026 A 11/2003

* cited by examiner

*Primary Examiner* — Stephen Meier
*Assistant Examiner* — John P Zimmermann
(74) *Attorney, Agent, or Firm* — Fitzpatrick, Cella, Harper & Scinto

(57) ABSTRACT

Provided is a liquid holding container in which waste liquid leakage is not caused even when the container is turned upside down. For this purpose, a surface of an absorber facing the rear face of a cover part is disposed apart from the cover part so as to form a space between the cover part and the absorber of a waste liquid holding container.

11 Claims, 9 Drawing Sheets

| | | z1 | z2 | z3 | z4 | z5 | z6 | z7 | TOTAL |
|---|---|---|---|---|---|---|---|---|---|
| HEIGHT mm | | 24 | 26 | 30 | 34 | 40 | 48 | 58 | |
| AVERAGE HOLDING RATIO | | 85% | 75% | 67.5% | 62.5% | 57.5% | 52.5% | 47.5% | |
| HOLDING AMOUNT ml | POSTURE 13a | 477 | 456 | 474 | - | - | - | - | 1408 |
| | POSTURE 13b | 147 | 140 | 146 | 153 | 166 | 181 | 198 | 1131 |

| | |
|---|---|
| L1 | 260mm |
| H1 | 80mm |
| D1 | 90mm |

LIQUID HOLDING CONTAINER

BACKGROUND OF THE INVENTION

Field of the Invention

The present invention relates to a liquid holding container to accommodate liquid (waste liquid or the like) which becomes unnecessary after having been used in a printing apparatus.

Description of the Related Art

In Japanese Patent Laid-Open No. 2003-312026, an opening part is provided to receive waste liquid at the center of the upper part of a holding container, and a dropping flow path part (space) is provided continuing to the bottom face of the container below the opening part for suppressing the evaporation of the waste liquid and causing the ink to be absorbed efficiently from the lower part in an absorber. Further, a wall is provided continuing to the bottom face so as to cause the ink not to be absorbed in the absorber between the opening part and the bottom face. The container is provided with a handle part which is used for carrying in replacement, and also an openable and closable upper cover is connected to a container main body via a pivotal part so as to allow the absorber to be replaced.

Further, for preventing the ink within the absorber from flowing because of gravity to ooze out from the absorber and to leak out from the container when the container is tilted in the container replacement, the pivotal part is provided on the same side of the handle and also a connection part of the upper cover of the holding container and the container main body is located at a position higher than the bottom face when the holding container is held in the vertical direction.

In the method of Japanese Patent Laid-Open No. 2003-312026, however, in the case that the container is turned completely upside down, sometimes the ink having oozed out from the absorber because of gravity (also called free ink) leaks out from the pivotal part or the connection part of the upper cover and the container main body, and, depending on the situation, from the opening part.

SUMMARY OF THE INVENTION

Accordingly, in view of such a problem, the present invention provides a liquid holding container in which waste liquid leak is not caused even when the container is turned upside down.

For this purpose, a liquid holding container comprising: an absorber configured to absorb liquid; a housing configured to accommodate the absorber thereinside; a cover part which is attached to an opening part of the housing and has an opening; and a cylindrical wall part extending from an opening edge of the opening in the cover part to an inside of the housing, wherein the cylindrical wall part and the absorber are disposed to overlap each other in an extension direction of the cylindrical wall part, and the absorber and the cover part are disposed apart from each other, is provided.

According to the present invention, it is possible to realize a liquid holding container in which waste liquid leak is not caused even when the container is turned upside down.

Further features of the present invention will become apparent from the following description of exemplary embodiments (with reference to the attached drawings).

DESCRIPTION OF THE EMBODIMENTS

First Embodiment

In the following, a first embodiment of the present invention will be explained with reference to the drawings. Note that the same sign indicates the same or corresponding part through the respective drawings.

Figure 1:
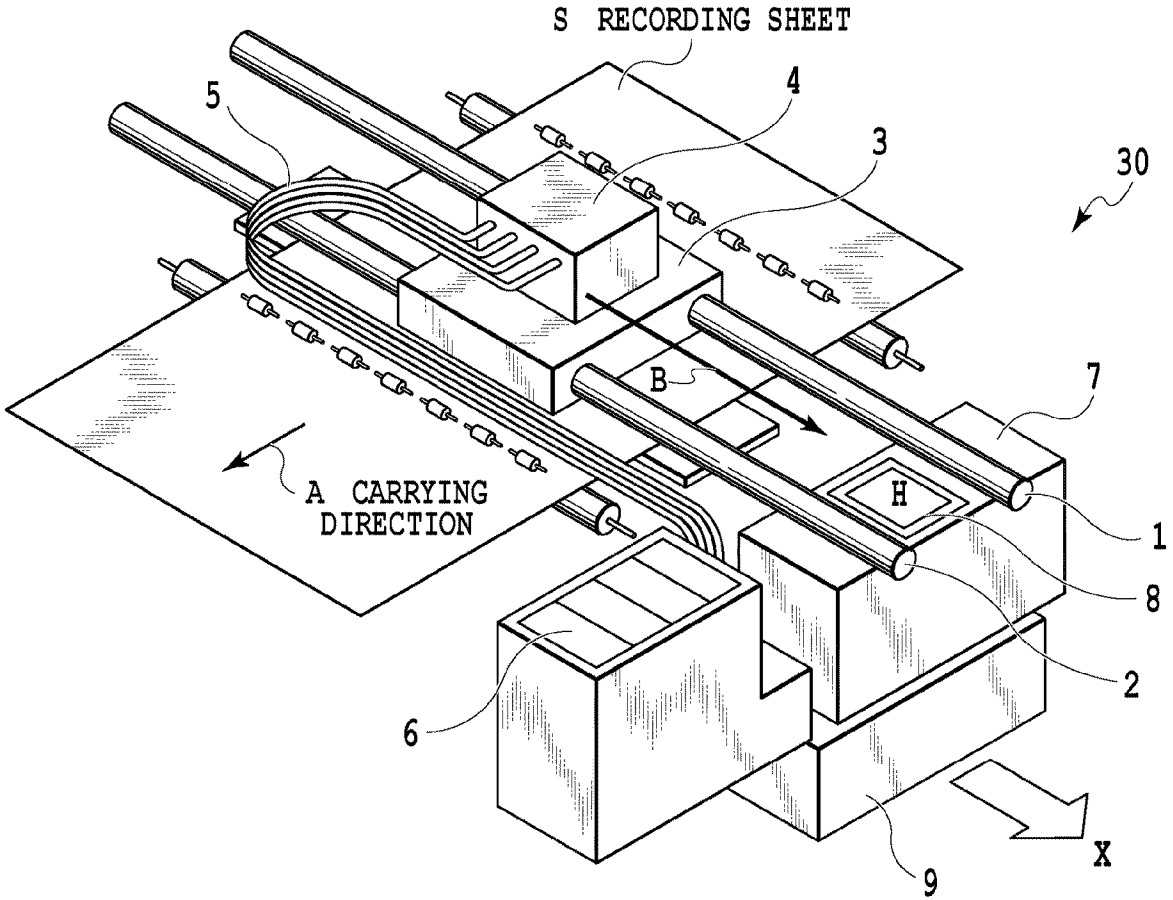
FIG. 1 is a schematic perspective view showing a part of a printing apparatus.

FIG. 1 is a schematic perspective view showing a part of a printing apparatus 30 to which the present embodiment can be applied. The printing apparatus 30 is provided with a guide rail 1 and a sub-rail 2 provided in parallel to the guide rail 1, and a carriage 3 is mounted on the guide rail 1. The carriage 3 is provided with an ejection head 4 to eject liquid and a liquid tank 6 via a liquid supply tube 5 to supply the liquid to the ejection head 4. The carriage 3 is guided by the guide rail 1 and the sub-rail 2 to be movable in the direction of the arrow B, and ejects the liquid from the ejection head 4 to a sheet S while moving.

The temperature of the ejection head 4 becomes high when the ejection of the liquid is repeated, and air bubbles are generated in the liquid inside the ejection head 4. Since such air bubbles cause non-ejection or the like, recovery processing is performed for removing the air bubbles or the like. In the recovery processing, the carriage 3 moves to a recovery processing position H and the recovery processing is performed by a recovery unit 7. In the recovery processing, a cap 8 is pressed to the ejection head 4, suction action is performed in this state by an un-illustrated pump mechanism (e.g., tube pump), and the liquid inside the ejection head 4 is pulled out by the reduced pressure inside the cap 8 and ejected to a waste liquid holding container 9. The waste liquid holding container 9 is configured to be detachable in the direction of the arrow X.

Figure 2:
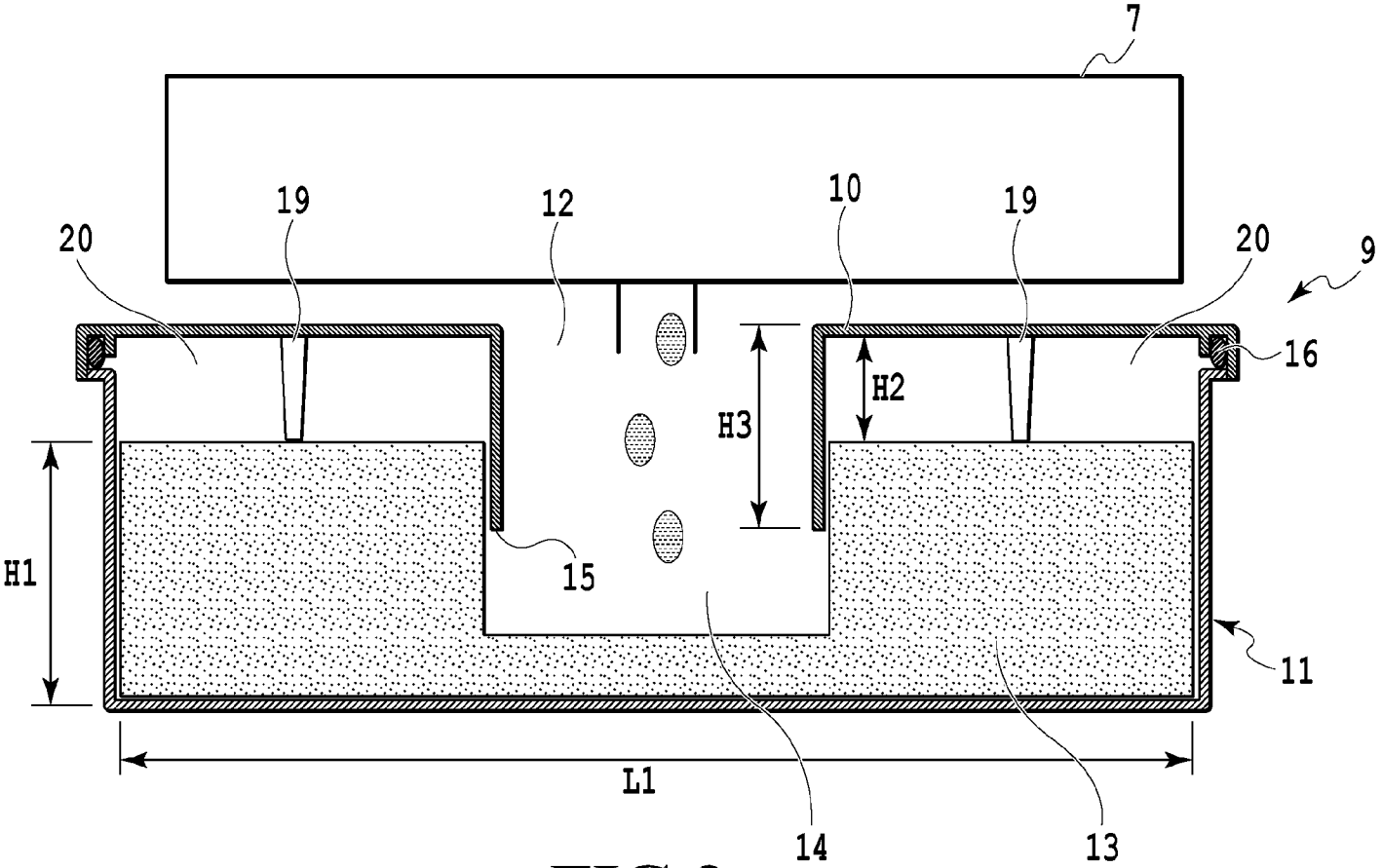
FIG. 2 is a cross-sectional view of a printing apparatus mounting a waste liquid holding container.

FIG. 2 is a cross-sectional view of the printing apparatus 30 mounting the waste liquid holding container 9 of the present embodiment, when viewed in the direction of the arrow B. The waste liquid holding container 9 is provided with a concave housing 11 configured to accommodate liquid and a cover part 10 attached to the upper face thereof, a packing material 16 is provided at the connection part of the housing 11 and the cover part 10 so that the waste liquid does not leak out, and the packing material 16 is fixed by an un-illustrated nail. Further, the cover part 10 of the waste liquid holding container 9 is provided with one liquid inlet port 12 to introduce the waste liquid ejected from the recovery unit 7 (liquid ejection unit) into the container. Further, a cylindrical wall 15 is provided at the edge part of the liquid inlet port 12, extending (protruding) toward the inside of the container.

The waste liquid holding container 9 is provided with an absorber 13 where a concave part 14 is formed, inside the container, and the absorber 13 is configured such that it is configured to absorb the waste liquid ejected from the recovery unit 7 and the liquid is received by the concave part 14. The concave part 14 of the absorber 13 is provided so as to surround the circumference of the cylindrical wall 15. Further, a rib 19 is provided having a height H2 from the rear face of the cover part 10 toward the absorber 13, and a space 20 having a predetermined volume corresponding to the height H2 of the rib 19 between the cover part 10 and the absorber 13.

The height of the cylindrical wall 15 from one end connected to the liquid inlet port 12 to the leading edge of the other end is configured to be larger than the height H2 of the rib 19. Further, the absorber 13 is configured to have a width L1 larger than a height H1 in a state when put into the waste liquid holding container 9. In the present embodiment, the height H1 of the absorber 13 is 80 mm, the width L1 is 260 mm, and the un-illustrated depth D1 is 90 mm.

Figures 3A, 3B:
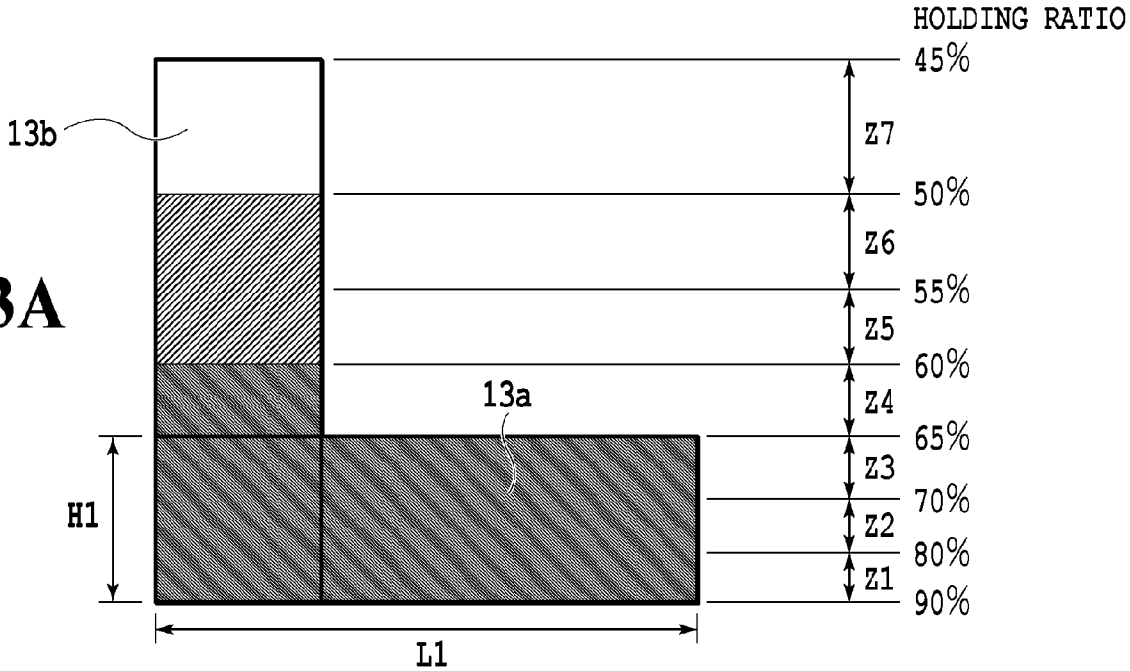
FIG. 3A is a diagram showing liquid absorption rates in absorption bodies having different postures.
FIG. 3B is a diagram showing liquid absorption rates in absorption bodies having different postures.

FIG. 3A is a diagram showing a liquid absorption rate at each level for different postures in an absorber made of the same material as the absorber 13 of the present embodiment. While the absorber made of felt or the like holds liquid against gravity by a strong capillary action of a fiber, the capillary action becomes weaker and gravity becomes stronger as the height of absorbed liquid surface becomes larger, and the held liquid goes down because of gravity. That is, the absorber has a liquid holding ratio which changes depending on the height, and the holding ratio is higher as the position is closer to the bottom face in the lower gravity direction.

Accordingly, in the absorber as shown in FIG. 3A, the ink amount held in the absorber becomes smaller in the posture 13*b* between the posture 13*a* where the height is smaller and the bottom area is larger (larger in the width direction) and the posture 13*b* where the height is larger and the bottom area is smaller. The posture 13*a* has the level Z3 even at height H1 of the highest position and the absorber has a holding ratio not smaller than 65%. However, while the posture 13*b* where the width L1 corresponds to the height keeps the same holding ratio of 65% as the posture 13*a* up to the level Z3, the holding ratio goes down as the height is increased to the level Z5 or level Z6, and the holding ratio goes down to 45% at the level Z7.

FIG. 3B is a table to list such a liquid holding amount at each level for each of the postures. The posture 13*a* holds 1408 ml and the posture 13*b* holds 1131 ml, and it is found that a holding amount difference of approximately 276 ml is caused by the difference in the posture even for the same shape. Liquid which cannot be held in the case that the absorber assumes the posture 13*b* (in the following, also called free ink) oozes out to the outside from the lower part of the absorber.

Figures 4A, 4B, 4C:
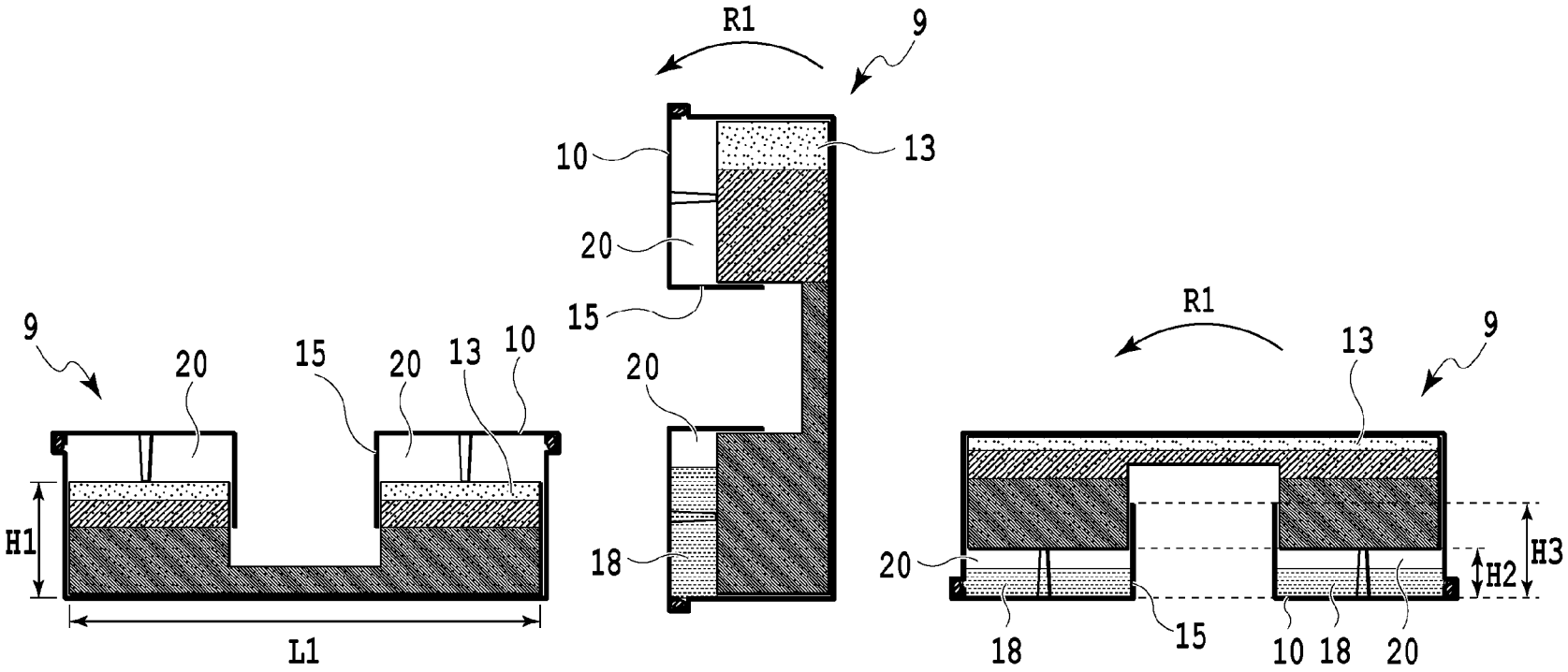
FIG. 4A is a diagram showing a waste liquid holding container having a different posture of the present embodiment.
FIG. 4B is a diagram showing a waste liquid holding container having a different posture of the present embodiment.
FIG. 4C is a diagram showing a waste liquid holding container having a different posture of the present embodiment.

FIG. 4A to FIG. 4C are diagrams showing the waste liquid holding container 9 having different postures in the present embodiment. In the posture when the cover part 10 is directed upward as shown in FIG. 4A, the absorber 13 has a length L1 larger than the height H1 and thereby the absorber 13 has a sufficient holding ability. However, when the waste liquid holding container 9 assuming the posture in FIG. 4A is tilted in the direction of the arrow R1 and assumes a posture perpendicular to the direction of the length L1 as shown in FIG. 4B, the ink cannot be held by the absorber 13 and the free ink 18 overflows from the absorber 13. In the present embodiment, however, the space 20 is provided between the absorber 13 and the cover part 10 and thereby the free ink 18 overflowing from the absorber 13 is accumulated in the space 20.

In the posture of FIG. 4B, the cylindrical wall 15 is provided at a position where the volume of the space 20 lower than the cylindrical wall 15 inside the container becomes larger than the volume of the free ink 18 oozing out from the absorber 13. In the present embodiment, the cylindrical wall 15 is located approximately at the center of the cover part 10, and the volume of the space 20 lower than the cylindrical wall 15 is approximately 300 ml. In this manner, even in the posture tilted vertically as in FIG. 4B, the free ink 18 oozing out from the absorber 13 is held inside the space 20, and the liquid surface of the free ink 18 is located under the liquid inlet port 12 and thereby the waste liquid does not leak out from the waste liquid holding container 9.

Further, the absorption ability of the absorber 13 holding the liquid becomes weak and therefore the free ink 18 once having oozed out needs a long time to be absorbed again by the absorber 13 even when the posture is changed. Accordingly, even when the waste liquid holding container 9 is tilted further from the posture of FIG. 4B in the direction of the arrow R1 and assumes a posture where the cover part 10 is directed downward as in FIG. 4C, sometimes the free ink 18 remains at the bottom part in FIG. 4C in an amount corresponding to the amount generated in FIG. 4B at a maximum. In this case also, in the present embodiment, the space 20 is provided between the absorber 13 and the cover part 10, and thereby the free ink 18 having overflowed from the absorber 13 is accumulated in the space 20 and does not leak out from the waste liquid holding container 9.

In the present embodiment, the liquid holding capacity is reduced by the concave part provided in the center part of the absorber 13, and the free ink 18 is generated in a volume of approximately 220 ml at a maximum for the whole absorber 13. On the other hand, the height of the rib 19, that is, the distance H2 between the cover part 10 and the absorber 13 is approximately 30 mm, and the volume of the space 20 is approximately 600 ml. Accordingly, the space 20 has a volume capable of sufficiently accommodating the free ink 18 generated in the absorber 13. Further, the height H3 of the cylindrical wall 15 is configured to be higher than the length H2 of the rib 19 (refer to FIG. 4C). In the present embodiment, while the length H2 is approximately 30 mm, the height H3 is approximately 45 mm. Accordingly, even in the state where the waste liquid holding container 9 is turned upside down as in FIG. 4C, the accumulated free ink 18 does not leak out from the liquid inlet port 12.

Note that, while, in the present embodiment, the space 20 is provided between the cover part 10 and the absorber 13 in the waste liquid holding container 9, a liquid holding space where the absorber 13 is not disposed may be provided on the bottom part or the side face part in the normal posture (FIG. 4A), for example.

Further, while, in the present embodiment, the space 20 is configured to be kept by the rib 19 between the cover part 10 and the absorber 13 even when the waste liquid holding container 9 is turned upside down, the present invention is not limited to this configuration. For example, the space 20 may be configured by pressure contact force of the absorber itself applied to the side face of the container by means of configuring the absorber 13 to be slightly larger than the container, or the cover part 10 may have a level difference and the lower step may contact the absorber 13, and thereby the space 20 may be configured between the higher step and the absorber.

Further, in the present embodiment, the distance H2 between the cover part 10 and the absorber 13 in the waste liquid holding container 9 is set to 30 mm, and the height H3 of the cylindrical wall 15 is set to 45 mm. However, in the case that the waste liquid held inside the waste liquid holding container is increased and the waste liquid exists inside the container exceeding the absorption ability of the absorber, the distance H2 and the height H3 may be set to values determined in consideration of the above situation.

Figures 5A, 5B, 5C:
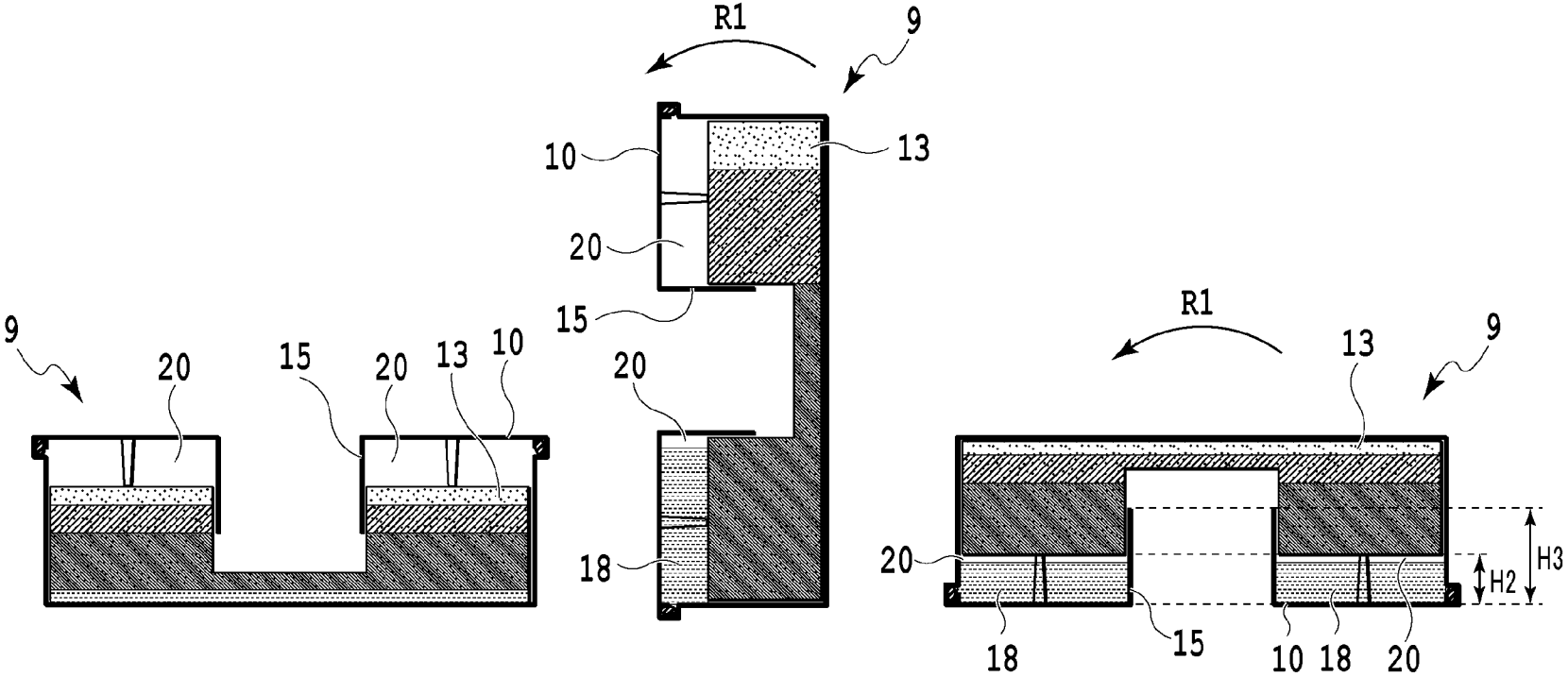
FIG. 5A is a diagram showing a waste liquid holding container accommodating waste liquid exceeding the absorption ability of an absorber.
FIG. 5B is a diagram showing a waste liquid holding container accommodating waste liquid exceeding the absorption ability of an absorber.
FIG. 5C is a diagram showing a waste liquid holding container accommodating waste liquid exceeding the absorption ability of an absorber.

Each of FIG. 5A to FIG. 5C is a diagram showing the waste liquid holding container accommodating the waste liquid exceeding the absorption ability of the absorber. Also in a configuration in which the free ink 18 oozes out from the absorber exceeding the liquid holding ability of the absorber 13 even in a normal posture as in FIG. 5A, it is possible to realize a waste liquid holding container without waste liquid leakage by optimizing the distances H2 and H3 and the position of the cylindrical part 15 depending on the configuration.

Further, in the opposite case that the holding ratio of the absorber is high or the waste liquid amount held inside the container is small, the amount of the generated free ink 18 becomes small and thus it is possible to reduce the size of the entire holding container by reducing the distances H2 and H3.

In this manner, one surface of the absorber 13 facing the rear surface of the cover part 10 is disposed apart from the cover part 10 so as to form the space 20 between the cover part 10 and the absorber 13 in the waste liquid holding container 9. Thereby, it becomes possible to realize a liquid holding container in which waste liquid leakage is not caused even when the container is turned upside down.

Second Embodiment

In the following, a second embodiment of the present invention will be explained with reference to the drawings. Note that, since the basic configuration of the present embodiment is the same as that of the first embodiment, only a characteristic configuration will be explained in the following, The same sign is used for the same constituent as that of the first embodiment.

Figure 6:
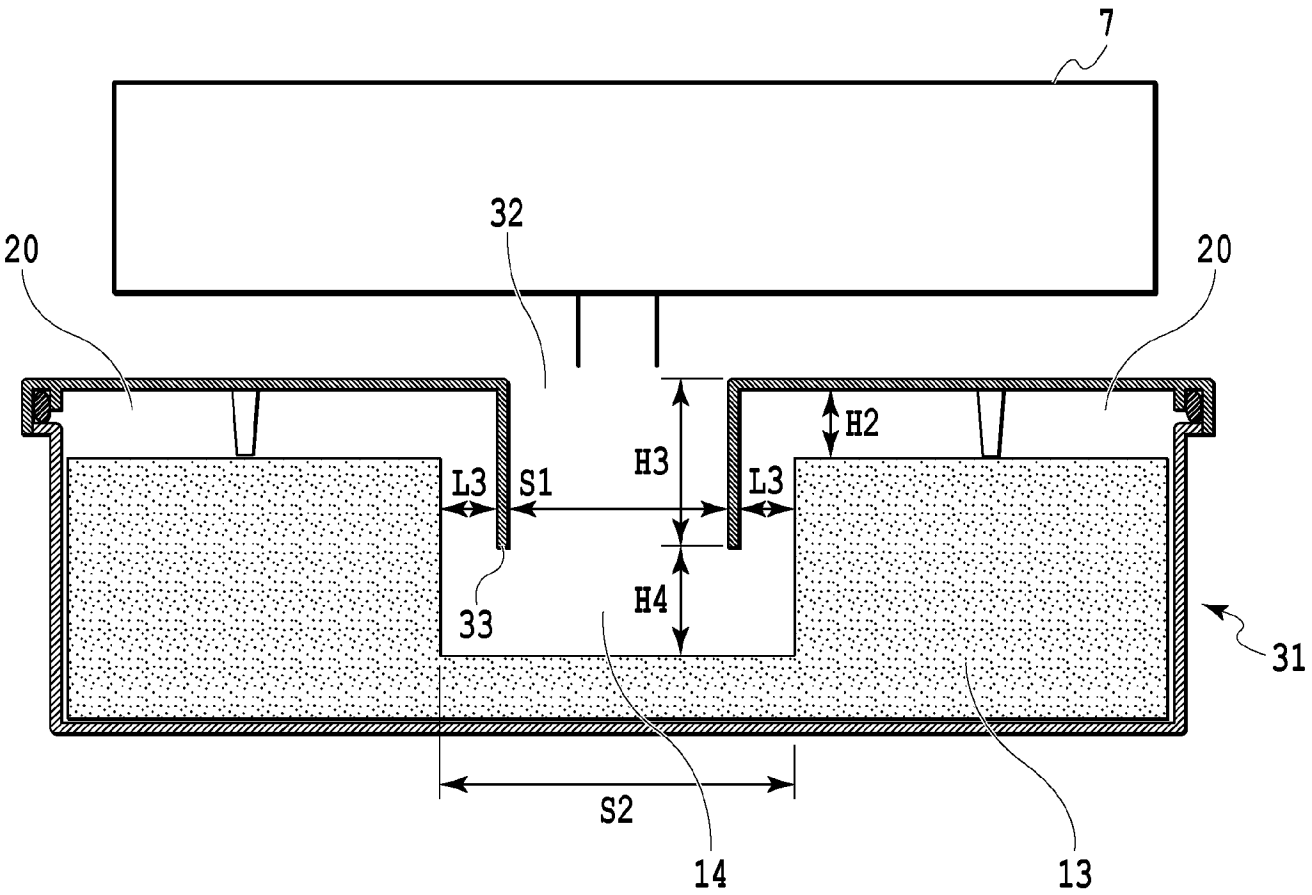
FIG. 6 is a cross-sectional view showing a waste liquid holding container.
Figure 7B:
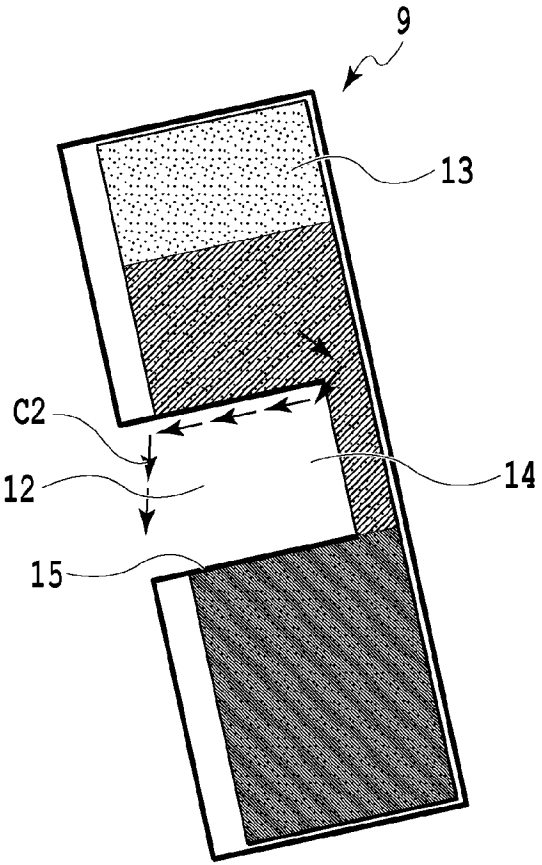
FIG. 7B is a diagram showing a liquid flow when a waste liquid holding container is tilted.
Figure 7A:
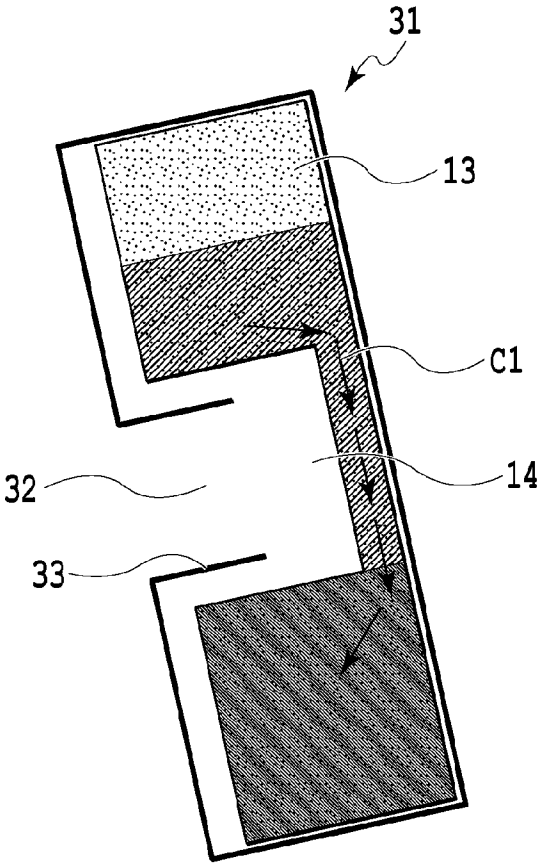
FIG. 7A is a diagram showing a liquid flow when a waste liquid holding container is tilted.

FIG. 6 is a cross-sectional view showing a waste liquid holding container 31 in the present embodiment, and each of FIG. 7A and FIG. 7B is a diagram showing a liquid flow when the waste liquid holding container 31 is tilted. The waste liquid holding container 31 of the present embodiment has a space between a concave part 14 provided in the center part of an absorber 13 and a cylindrical wall 33 provided in the center part of a cover part 10. FIG. 7A shows the waste liquid holding container 31, and FIG. 7B shows the waste liquid holding container 9 of the first embodiment. When the waste liquid holding container is tilted further from a vertical posture (refer to FIG. 4B), liquid inside the absorber moves in the lower direction from above. Then, if the absorber 13 and the cylindrical wall 15 contact each other, when the liquid passes through the concave part 14 of the absorber 13, the liquid may leak out along the cylindrical wall 15 as the flow C2 of FIG. 7B.

Accordingly, in the present embodiment, a space is provided between the absorber 13 and the cylindrical wall 33 as in FIG. 7A, and thereby the liquid of the absorber 13 is arranged not to leak out to the outside along the cylindrical wall 33. The waste liquid holding container 31 of the present embodiment has a spacing L3 between the side part of the cylindrical wall 33 and the side face of the concave part in the absorber 13 as in FIG. 6, and further has a spacing H4 between the lower edge part of the cylindrical wall 33 and the bottom face of the concave part in the absorber 13. Since spacing is provided between the cylindrical wall 33 and the absorber 13 in this manner, the liquid inside the absorber does not contact the cylindrical wall 33 when moving in the lower direction from above. Accordingly, the liquid does not leak out from a liquid inlet port 32 along the cylindrical wall 33, and can move in the lower direction inside the absorber as the flow C1.

Further, by providing a space corresponding to the spacing L3, it is possible to utilize this space for the space 20 to hold the free ink 18, and to reduce the size of the waste liquid holding container 31 by reducing the spacing H2 between the cover part 10 and the absorber 13 compared with the first embodiment.

Figure 8B:
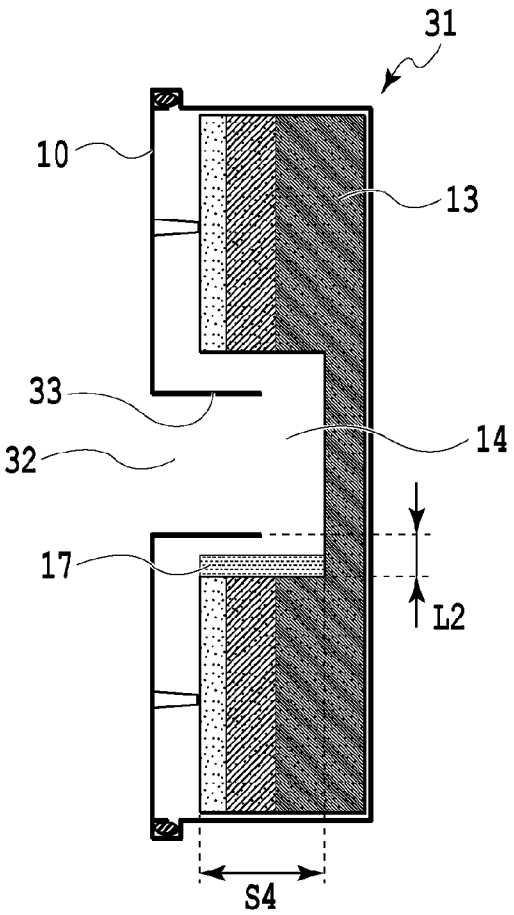
FIG. 8B is a diagram showing a state just after waste liquid is supplied exceeding a holding capacity of an absorber.
Figure 8A:
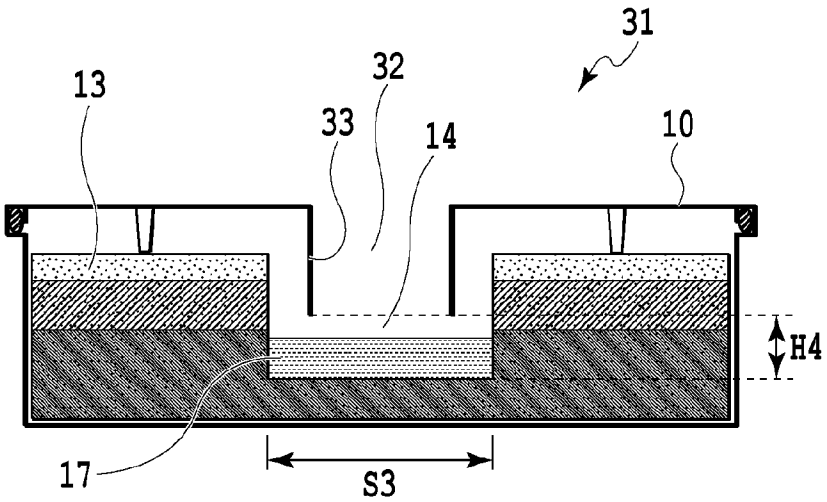
FIG. 8A is a diagram showing a state just after waste liquid is supplied exceeding a holding capacity of an absorber.

Each of FIG. 8A and FIG. 8B is a diagram showing a state just after waste liquid 17 is supplied from a recovery unit 7 exceeding the liquid holding capacity of the absorber 13 in the waste liquid holding container 31 of the present embodiment. In the state where the liquid holding capacity of the absorber 13 is exceeded and the liquid holding ability is reduced, in the case that the waste liquid 17 is supplied by the suction action of the recovery unit 7, sometimes the waste liquid 17 which cannot be absorbed in the concave part 14 of the absorber 13 is accumulated temporarily. When the waste liquid holding container 31 is tilted in this state, the waste liquid 17 which cannot be absorbed by the absorber 13 may overflow from the liquid inlet port 32.

Accordingly, in the present embodiment, the space is configured to be a space which is configured with the area S3 of the bottom face of the concave part 14 and the spacing H4 between the lower edge part of the cylindrical wall 33 and the bottom face of the concave part 14 and provided with a capacity to sufficiently hold the waste liquid. That is, the amount of the waste liquid 17 generated (ejected) in one suction action of the recovery unit 7 is configured to be accommodated sufficiently in the space defined by the bottom face of the concave part 14, a part of the side face of the concave part 14, and the lower edge part of the cylindrical wall 33. In the present embodiment, the amount of the waste liquid 17 generated by one suction action of the recovery unit 7 is assumed to be 50 ml, and, for this waste liquid amount, the spacing H4 is set to approximately 40 mm, the area S2 is set to approximately 4700 $mm^2$, and the capacity of the space is 188 ml. Accordingly, since the lower edge part of the cylindrical wall 33 is higher than the liquid surface of the waste liquid 17, even if the container is tilted in the state where the waste liquid 17 is scarcely absorbed, the waste liquid 17 does not overflow from the liquid inlet port 32.

Further, in the case that the waste liquid holding container 31 is caused to assume a vertical posture as in FIG. 8B just after the waste liquid 17 is supplied from the recovery unit 7, the waste liquid 17 may overflow from the liquid inlet port 32 in a process from the state of FIG. 8A to the state of FIG. 8B. Accordingly, in the present embodiment, the space which is configured with the area S4 of the side face of the concave part 14 of the absorber 13 and the spacing L2 between the side face of the cylindrical wall 33 and the side face of the concave part 14, is configured to have a volume larger than the amount of the waste liquid 17 generated by one suction action of the recovery unit 7. In the present embodiment, the area S4 is set to approximately 5000 $mm^2$, the distance L2 is set to approximately 12 mm, and the space has a volume of 60 ml. Thereby, even in the case that the waste liquid 17 still remains even when the container is tilted, the cylindrical wall 33 is located at a higher position than the liquid surface of the waste liquid 17, and therefore the waste liquid 17 does not leak out from the liquid inlet port 32 when the container is tilted.

Note that, by the utilization of the space 20, the volume of a space under the cylindrical wall 33 without the absorber 13 (total volume of the space 20 under the cylindrical wall 33 and the space configured with the area S4 and the spacing L3) may be configured to be larger than the amount of the waste liquid 17.

Variation Example

Figure 9:
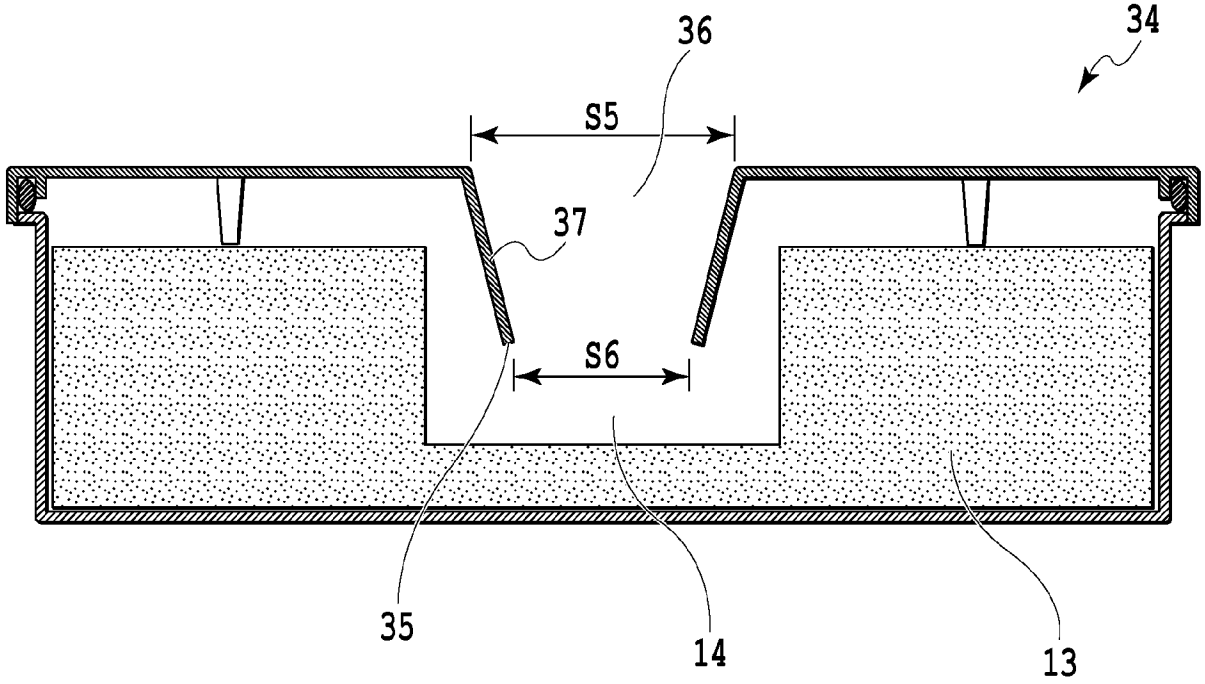
FIG. 9 is a diagram showing a waste liquid holding container of a variation example.

FIG. 9 is a diagram showing a waste liquid holding container 34 according to a variation example of the present embodiment. In the waste liquid holding container 34 of the variation example, a cylindrical wall 37 has a tapered shape in which the opening area becomes smaller from the base to the lower end part 35. That is, the cylindrical wall 37 is configured so as to cause the opening area S6 in the lower edge part of a cylindrical wall 37 to be smaller than the opening area S5 in the opening part of a liquid inlet port 36. Thereby, the waste liquid becomes difficult to scatter to the outside when the waste liquid is introduced from the recovery unit 7, and, on the other hand, when the container is tilted, the waste liquid is configured to be easily introduced in the gap between the cylindrical wall 37 and the absorber 13 and the gap can be used more efficiently.

Note that, in either the first embodiment or the second embodiment, while the width L1 of the absorber 13 is configured to be larger than the height H1 of the absorber 13 in the posture when the container is mounted to the printing apparatus, the length D1 of the absorber 13 in the depth direction may be equivalent to the width L1 or larger than the width L1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-194016 filed Sep. 30, 2015, which is hereby incorporated by reference herein in its entirety.

What is claimed is:

1. A liquid holding container comprising:

an absorber configured to absorb liquid discharged from a recovery unit which performs a recovery process for an ejection head, the absorber having a first surface and a concave part having a second surface lower than the first surface and receiving liquid discharged from the recovery unit;

a housing configured to accommodate the absorber therein-inside; and a cover part which is attached to an opening part of the housing, the cover part having an upper surface provided at a predetermined distance from the first surface and a cylindrical wall part formed on the upper surface and extending from an opening provided at a position opposed to the concave part toward the concave part, an end of the cylindrical wall part being located between the first surface and the second surface.

2. The liquid holding container according to claim 1, further comprising a rib extending from the cover part to an inside of the housing, wherein a tip of the rib contacts a surface of the absorber.

3. The liquid holding container according to claim 2, wherein a length of the cylindrical wall part in an extension direction of the cylindrical wall part is longer than a length of the rib.

4. The liquid holding container according to claim 1, wherein the cylindrical wall part and the absorber are disposed apart from each other when viewed along an extension direction of the cylindrical wall part.

5. The liquid holding container according to claim 1, wherein the concave part of the absorber is recessed from a surface facing the cover part to an inside, and wherein a leading edge of the cylindrical wall part extending to an inside of the housing and a bottom face of the concave part of the absorber are disposed apart from each other.

6. The liquid holding container according to claim 5, wherein the cylindrical wall part and a side face of the concave part of the absorber are apart from each other.

7. The liquid holding container according to claim 5, wherein the absorber has a length in a width direction longer than a height of the absorber in a posture in which the concave part is directed upward, and wherein when the absorber is caused to assume a posture in which the concave part is directed horizontally, liquid output from the absorber can be accommodated, the absorber having absorbed the liquid in an amount absorbable by the absorber assuming a posture in which the concave part is directed upward.

8. The liquid holding container according to claim 5, wherein the absorber has a length in a width direction longer than a height of the absorber in a posture in which the concave part is directed upward, and wherein when the absorber is caused to assume a posture in which the concave part is directed downward, liquid output from the absorber can be accommodated, the absorber having absorbed the liquid in an amount absorbable by the absorber assuming a posture in which the concave part is directed upward.

9. The liquid holding container according to claim 6, wherein the liquid holding container holds liquid ejected from a liquid ejection unit, and wherein liquid ejected by the liquid ejection unit at one time can be accommodated in a space defined by the leading edge of the cylindrical wall part extending to the inside of the housing, the bottom face of the concave part, and a part of the side face of the concave part.

10. The liquid holding container according to claim 6, wherein the liquid holding container holds liquid ejected from a liquid ejection unit, and wherein liquid ejected by the liquid ejection unit at one time can be accommodated in a space defined by the side face of the concave part, a part of the bottom face of the concave part, and a part of the cylindrical wall part.

11. The liquid holding container according to claim 1, wherein an opening area of the cylindrical wall part on a side of leading edge is smaller than that on a side of an opening edge at the opening provided at the position opposed to the concave part.

* * * * *